US007397192B2

(12) United States Patent
Damm et al.

(10) Patent No.: US 7,397,192 B2
(45) Date of Patent: Jul. 8, 2008

(54) HALOGEN INCANDESCENT LAMP

(75) Inventors: Matthias Damm, Gaimersheim (DE); Christoph Krieglmeyer, Hitzhofen/Hofstetten (DE); Roland Stark, Welheim (DE)

(73) Assignee: Patent-Treuhand-Gesellschaft für elektrische Glühlampen mbH, Munich (DE)

( * ) Notice: Subject to any disclaimer, the term of this patent is extended or adjusted under 35 U.S.C. 154(b) by 567 days.

(21) Appl. No.: 11/172,788

(22) Filed: Jul. 5, 2005

(65) Prior Publication Data

US 2006/0006801 A1 Jan. 12, 2006

(30) Foreign Application Priority Data

Jul. 8, 2004 (DE) ..... 10 2004 033 117

(51) Int. Cl.
*H01J 17/16* (2006.01)

(52) U.S. Cl. ..... 313/634; 313/579; 313/635

(58) Field of Classification Search ..... 313/573, 313/578, 579, 634, 635, 317, 112, 113
See application file for complete search history.

(56) References Cited

U.S. PATENT DOCUMENTS

| | | | | |
|---|---|---|---|---|
| 2,135,480 | A * | 11/1938 | Birdseye | 313/113 |
| 3,344,303 | A * | 9/1967 | Prenger | 313/114 |
| 4,174,487 | A * | 11/1979 | Peeters | 313/113 |
| 4,370,587 | A * | 1/1983 | Notelteirs | 313/113 |
| 4,988,911 | A | 1/1991 | Miller | |
| 6,075,318 | A | 6/2000 | Noll et al. | |
| 2006/0170361 | A1 * | 8/2006 | Brock et al. | 313/634 |
| 2006/0186816 | A1 * | 8/2006 | Kurosawa | 313/635 |
| 2006/0238121 | A1 * | 10/2006 | Stark | 313/634 |
| 2006/0244383 | A1 * | 11/2006 | Goihl et al. | 313/634 |

FOREIGN PATENT DOCUMENTS

| | | | |
|---|---|---|---|
| EP | 0 446 460 | | 9/1991 |
| EP | 0446460 | A2 | 9/1991 |
| EP | 0 495 194 | | 7/1992 |
| EP | 0495194 | A2 | 7/1992 |
| EP | 0897604 | A1 | 2/1999 |
| GB | 1097409 | A | 1/1968 |

* cited by examiner

*Primary Examiner*—Peter Macchiarolo
(74) *Attorney, Agent, or Firm*—William E. Meyer

(57) ABSTRACT

Disclosed is a halogen incandescent lamp having a lamp vessel, which is sealed at one end and in which at least one luminous element is accommodated, a vessel section 42 being in the form of a side reflector which extends only over a subregion of the lamp vessel circumference. A light-exit window 40 adjoins this vessel section 42 in the circumferential direction. According to the invention, the light-exit window 40 is comparatively slightly curved in cross section, the vessel section 42 forming the side reflector bulging out away from the light-exit window 40. This bulged-out region is preferably provided with a kidney-shaped constriction 46.

14 Claims, 3 Drawing Sheets

HALOGEN INCANDESCENT LAMP

TECHNICAL FIELD

The invention relates to a halogen incandescent lamp in accordance with the preamble of patent claim 1.

BACKGROUND ART

Such a side reflector lamp is described under the product designation "MINISTAR®" at the Internet domain www.osram.de. With this halogen incandescent lamp, a circumferential section of a lamp vessel is provided with a reflective coating such that a laterally arranged light-exit window remains on the lamp vessel, and this light-exit window makes it possible to use this lamp, for example, as a downlight, the lamp being mounted in the horizontal direction. Such reflector lamps have an extremely compact design and therefore require a minimum amount of installation space when they are installed.

This known design is significantly simpler than conventional reflector lamps, as are described, for example, in the European patent specification EP 0 495 194 B1. Such reflector lamps comprise a reflector, which is formed by a parabolic or ellipsoidal glass cap, and a halogen incandescent lamp which is fixed in the optical axis of the reflector.

It has been shown that the compact halogen incandescent lamps having a reflector integrated in the lamp vessel can be improved as regards the radiated luminous flux in particular when a luminous element which is accommodated in the lamp vessel is formed with at least two filament sections. Luminous elements having two filament sections are used, for example, in the case of halogen incandescent lamps envisaged for operation using the system voltage, as are described in the European patent specification EP 0 446 460 B1.

DISCLOSURE OF THE INVENTION

The invention is based on the object of providing a halogen incandescent lamp having a side reflector with which the illumination of a predetermined area is improved.

This object is achieved according to the invention by a halogen incandescent lamp having a lamp vessel, which is sealed at one end and in which at least one luminous element is accommodated, a vessel section being in the form of a side reflector which extends over a subregion of the lamp vessel circumference, and a light-exit window of the lamp vessel adjoining the vessel section in the circumferential direction, whereby, in the cross section of the lamp vessel, the vessel section forming the side reflector bulges out away from the flat or comparatively slightly curved light-exit window.

The halogen incandescent lamp according to the invention has a lamp vessel, which is sealed at one end and in which at least one luminous element is accommodated, a section of the lamp vessel being in the form of a side reflector which extends only over a subregion of the lamp vessel circumference such that a light-exit window remains. According to the invention, when viewed in cross section, the vessel section acting as the reflector bulges out away from the light-exit window which has a comparatively flat curve or is of planar design. The average radius of curvature of the light-exit window is in this case greater than the average radius of curvature of the vessel section acting as the reflector which bulges out towards the rear. That is to say the lamp vessel which is generally cylindrical is given, in the region of the reflector, a curvature which is, for example, approximately parabolic or ellipsoidal and is thus optimized as regards the reflection properties such that the luminous flux emerging from the light-exit window is greater than in the case of conventional solutions, and targeted illumination of a predetermined area is made possible.

The width, when viewed in cross section, of the light-exit window is preferably greater than the depth of the vessel section in the form of a reflector.

The invention may particularly advantageously be used in a halogen incandescent lamp, in the case of which the luminous element is designed to have two filament branches. In this case, a constriction which extends in the direction towards the light-exit window is formed at a vertex of the bulge of the reflective vessel section such that a rear wall of the vessel section is pulled in to form the shape of a kidney. In other words, the lamp bulb which is in the form of a reflector is provided with two depressions, whose geometry is designed such that the light radiation emitted by each filament branch is reflected in optimum fashion.

With this solution, it is particularly preferable if this constriction is arranged on a plane of symmetry with respect to the filament branches.

The luminous elements, in particular in the case of halogen incandescent lamps envisaged for the system voltage, are fixed using holding knobs, as are described in the European patent specification mentioned initially EP 0 446 460 B1. Such holding knobs are in principle inward curves in the lamp housing between which a subregion of the luminous element is clamped. With the solution according to the invention, a holding knob is preferably formed in the region of the emission window, and a holding knob, which is arranged diametrically with respect thereto, is formed in the region of the rearward constriction.

The luminous element is advantageously designed to have two filament branches which are preferably arranged at an angle with respect to one another and which are connected to one another via a connecting part which is gripped by the holding knobs.

In one preferred exemplary embodiment, the reflective vessel section is provided with a coating which is preferably applied to the outer circumference of the lamp vessel.

The sealed end of the lamp vessel is advantageously in the form of a base, as is described, for example, in the Unites States patent specification U.S. Pat. No. 6,075,318 B1.

In an exemplary embodiment according to the invention, the lamp vessel merges with this base via a circumferential bevel.

The base is preferably arranged closer to the vertex of the reflective vessel section than to the vertex of the light-exit window.

An exhaust tube attachment for the purpose of filling the halogen incandescent lamp can be arranged on a dome which overlaps the reflective vessel section.

According to the invention, it is preferred if the halogen incandescent lamp is designed for operation using the system voltage.

BRIEF DESCRIPTION OF THE DRAWINGS

The invention will be explained in more detail below with reference to a preferred exemplary embodiment. In the drawings.

BEST MODE FOR CARRYING OUT THE INVENTION

Figure 1:
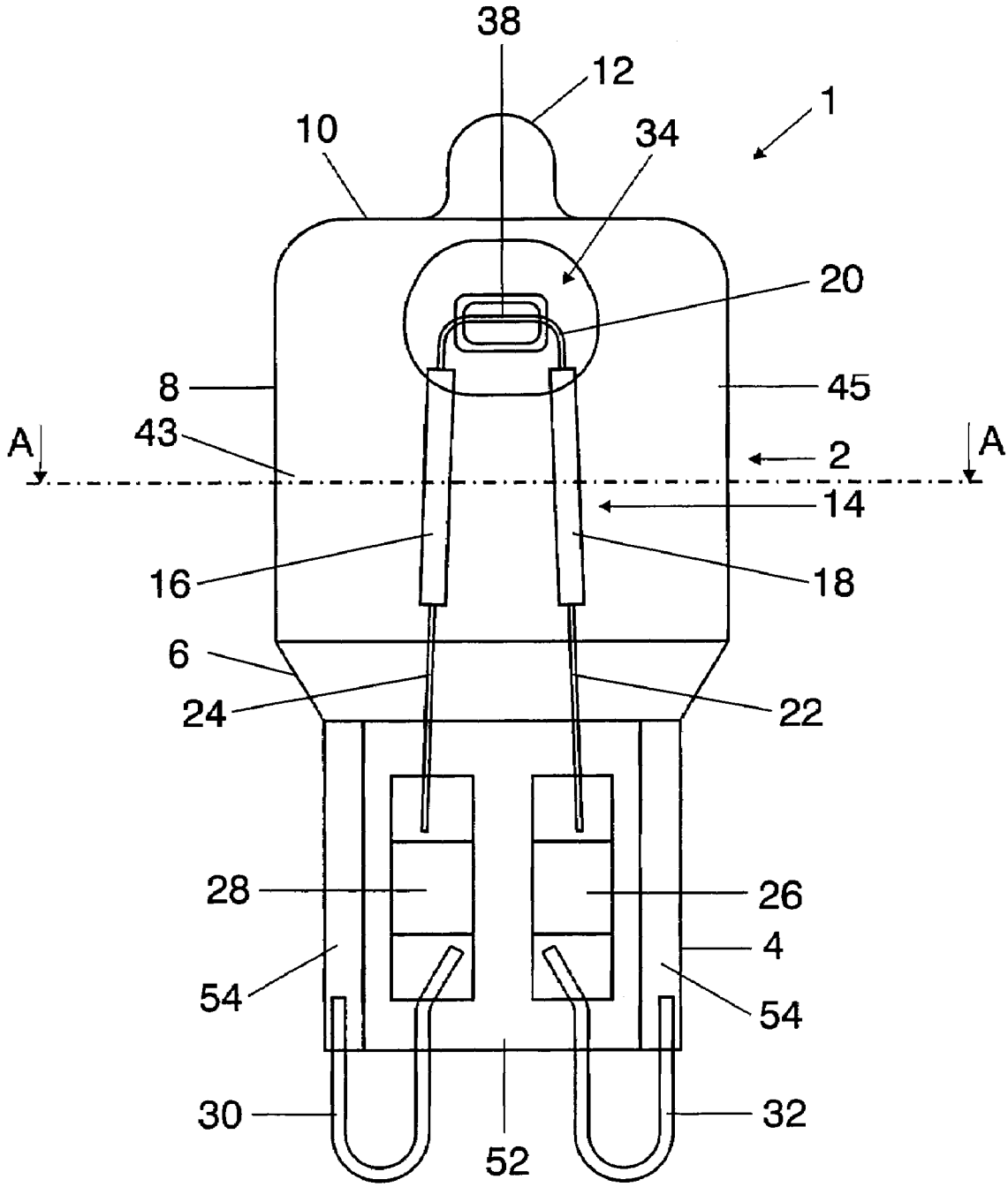
FIG. 1 shows a front view of a halogen incandescent lamp according to the invention.
Figure 2:
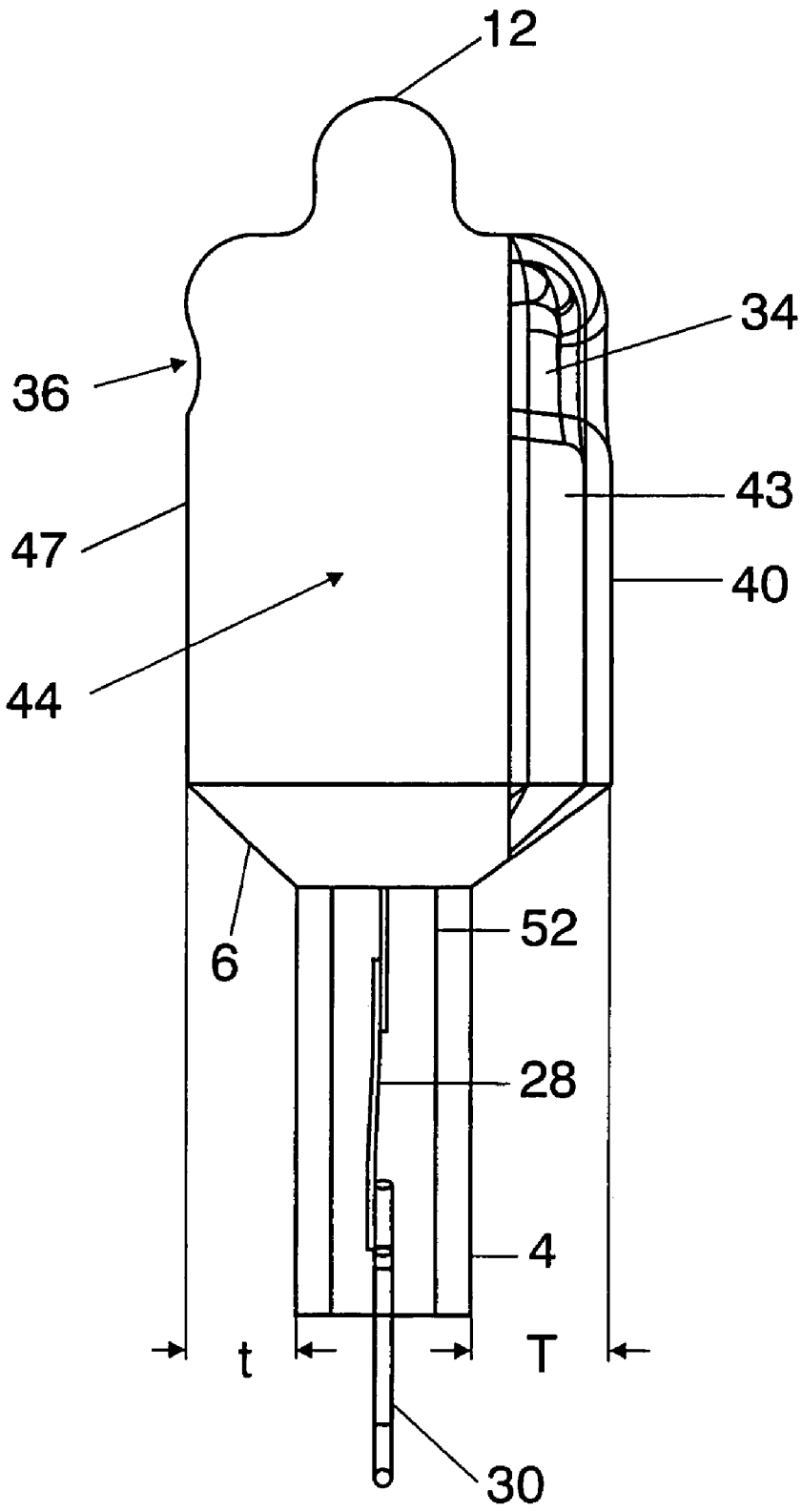
FIG. 2 shows a side view of the halogen incandescent lamp shown in FIG. 1.
Figure 3:
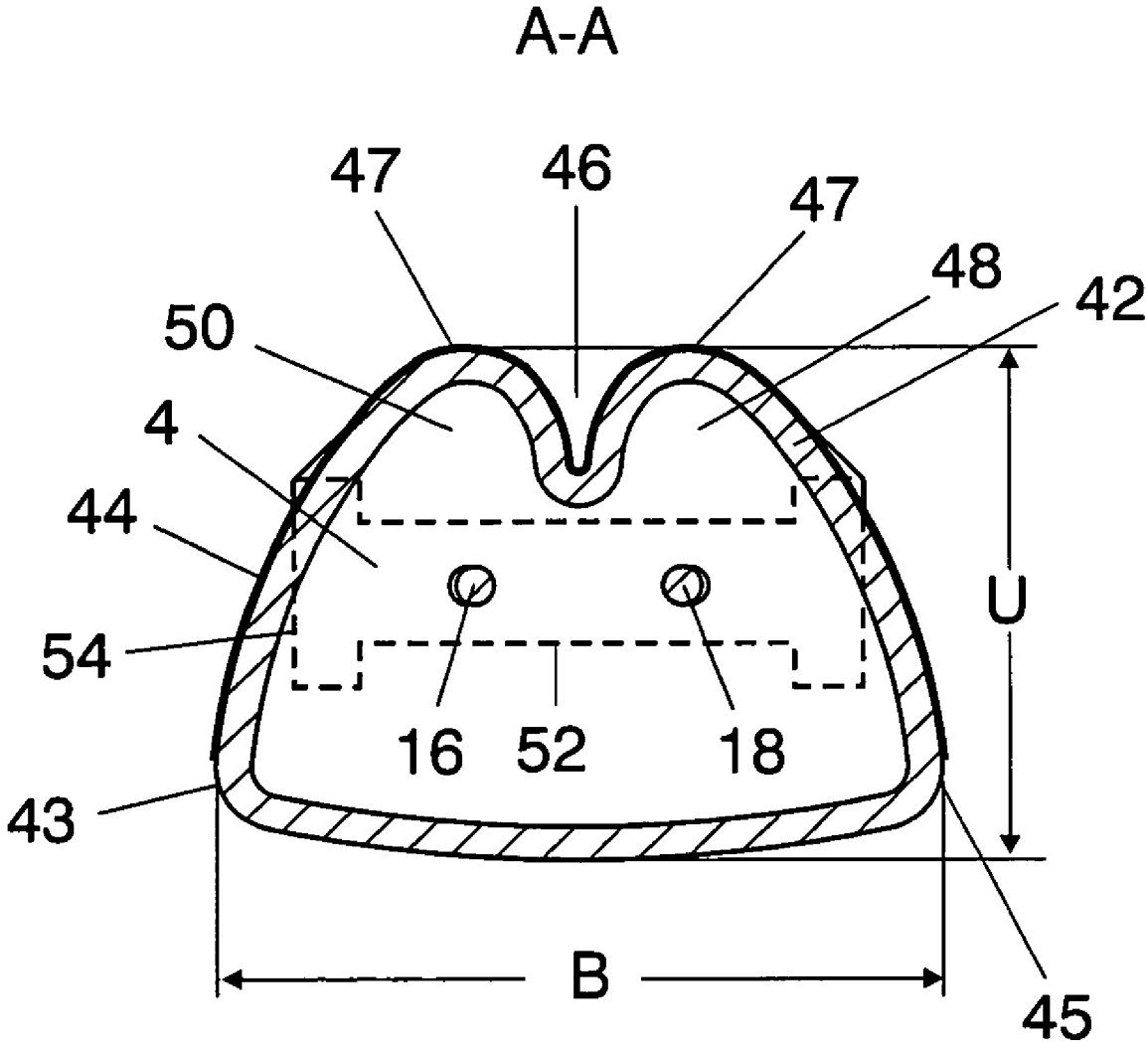
FIG. 3 shows a section along the line A-A in FIG. 1.

FIGS. 1 to 3 show a halogen incandescent lamp 1 which is designed for operation using the system voltage. In principle, however, the invention can also be used for low-voltage or medium-voltage halogen incandescent lamps.

The halogen incandescent lamp 1 has, as shown in FIGS. 1 and 2, a lamp vessel 2, which is preferably made of quartz glass and on whose lower end section in FIG. 1 is formed a base 4 by means of a pinch seal, it being possible for said base 4 to be inserted in a lampholder (not shown). This base 4 merges with a bulb 8 of the lamp vessel 2 via a circumferential bevel 6. The end section, which is remote from the base 4, of the lamp vessel 2 is formed by a dome 10 on which is formed an exhaust tube attachment 12.

Arranged in the lamp vessel 2 is a luminous element 14 which is designed, in the exemplary embodiment described, to have two filament branches 16, 18 which are connected to one another via a connecting part 20. As can be seen in FIG. 1, the filament branches 16, 18 are positioned at an angle with respect to one another such that the spacing between them is greater at the bottom, towards the base 4. The two filament branches 16, 18 merge with power supply lines 22, 24, whose end sections enter the base 4 formed by the pinch seal and are each connected to a molybdenum film 26, 28 which are likewise embedded in the base 4. In turn, these molybdenum films are connected to approximately U-shaped, outer power supply lines, referred to below as contacts 30, 32, whose bent-back end sections enter channels in the base 4 or are embedded in said channels. The filament branches 16, 18, the connecting part 20 and the two power supply lines 22, 24 are preferably produced from tungsten.

The two power supply lines 22, 24, which are embedded in the base 4, are not stable enough to position the two filament branches 16, 18 in their predetermined relative position within the bulb 8. Holding knobs 34, 36, which, in the illustration shown in FIG. 1, extend perpendicular to the plane of the drawing and, in the illustration shown in FIG. 2, extend parallel to the plane of the drawing, are therefore formed on the lamp vessel 2 approximately at the height of the intermediate part 20. These holding knobs 34, 36, which lie diametrically in relation to one another, are formed by wall regions, which are deformed inwards, towards the intermediate part 20, of the bulb 8, i.e. the wall of the bulb 8 is deformed inwards in the region of these holding knobs 34, 36 such that the connecting part 20 is clamped between the two end faces of the holding knobs 34, 36 and thus the filament branches 16, 18 are fixed in position. This technology for the knobs is explained in detail in EP 0 446 460 B1 mentioned initially. In the exemplary embodiment illustrated, the holding knobs 34, 36 are each formed with an approximately elliptical cross section, whose longitudinal axis overlaps that region 38 of the connecting part 20 which is arranged horizontally in FIG. 1, in order to achieve a maximum connecting area between the elliptical end sides of the holding knobs 34, 36 and the connecting part 20.

During manufacture, an exhaust tube is attached to the exhaust tube attachment 12, the interior of the bulb 8 being evacuated and being filled with a filling gas containing halogens via said exhaust tube. After filling, the exhaust tube is removed and the exhaust tube attachment 12 is fused in.

As can be seen in particular in the section along the line A-A in FIG. 1 which is illustrated in FIG. 3, the bulb 8 is not designed to have a cylindrical cross section, as is the case with the prior art described initially, but has a light-exit window 40, which points towards the viewer in the illustration shown in FIG. 1, a vessel section 42 which bulges out towards the rear, i.e. away from the light-exit window 40, adjoining said light-exit window 40. The light-exit window 40 in the process merges with the rearwardly bulged-out vessel section 42 via two rounded-off surface sections 43, 45. A light-reflecting layer 44 is applied to the outer circumference surface of the vessel section 42 (as indicated by dashed lines in FIG. 3), and this light-reflecting layer 44 may be, for example, a dichroitic layer or a silver or aluminum layer. The coating is indicated in FIG. 2 by means of hatching. The light-exit window 40 is not covered by this reflective layer 44.

As shown in FIG. 3, the wall regions of the vessel section 42 which adjoin the light-exit window 40 have an approximately parabolic or ellipsoidal curvature, a constriction 46 being formed at the vertex, owing to which constriction 46 the wall curves in backward again towards the light-exit window 40 so as to form approximately the shape of a kidney.

This constriction 46 forms two curved reflective regions 48, 50 which are each associated with one of the filament branches 16, 18 and surround sections of these at a spacing. The reflective regions 48, 50 each form a reflector element, by means of which the light which is radiated by the associated filament branch 16, 18 is reflected in the direction of the exit window 40 such that the transmission angle of the halogen lamp 1 is limited considerably more severely than is the case for conventional lamps, and thus uniform illumination of a predetermined area is made possible.

The constriction 46 extends at the rear practically over the entire height of the vessel section 42 up to the bevel 6, the two reflective regions 48, 50 correspondingly also extending over a region which is higher than the length of the two filament branches 16, 18.

The lowest point, when viewed in cross section, of the constriction 46 is on a plane of symmetry between the two filament branches 16, 18, which extends perpendicular to the plane of the drawing in FIG. 3. As illustrated in FIG. 3, the width B of the exit window is greater than the depth U, i.e. greater than the maximum spacing between the light-exit window 40 and the inwardly curved rear wall or the two vertices 47 of the vessel section 42. The cross-sectional shape of the bulb 8 of the exemplary embodiment illustrated is also characterized by the fact that the average radius of curvature of the light-exit window 40, in the view shown in FIG. 3, is greater than that for the vessel section 42 which bulges out to the rear.

As shown in FIG. 2, the base 4 is moved slightly to the left, towards the constriction 46, such that the spacing T from the vertex of the exit window 40 is greater than the spacing t from the two vertices 47 of the vessel section 42 which are arranged perpendicular to the plane of the drawing in the illustration shown in FIG. 2 and are formed by the constriction 46 (only visible in FIG. 3). As can be seen in particular in FIG. 2, the exhaust tube attachment 12 is arranged as an extension of the vertical axis of the base 4 and is thus likewise offset towards the vertex 47 of the two kidney-shaped reflective regions 48, 50. With the base type illustrated, the region 52 which is central in FIG. 1 has a section removed on both sides (perpendicular to the plane of the drawing in FIG. 1) such that two webs 54 remain at the edge of the base 4.

The coating preferably extends up to the two surface sections 43, 45 and also overlaps the dome 10 and at least part of the bevel 6, also that region of the bevel 6 which is arranged below the light-exit window 40 (FIG. 1) preferably being coated.

What is claimed is:

1. A halogen incandescent lamp a lamp vessel, sealed at one end and in which at least one luminous element is accommodated, a vessel section being in the form of a side reflector which extends over a subregion of the lamp vessel circumference, and a light-exit window of the lamp vessel adjoining the vessel section in the circumferential direction, whereby, in the cross section of the lamp vessel, the vessel section forming the side reflector bulges out away from the flat or comparatively slightly curved light-exit window, and wherein the luminous element has two filament branches, and the side reflector is formed with a constriction extending in a direction towards the light-exit window and between the two filament branches thereby dividing the side reflector into two respective reflector regions each facing a respective one of the two filament branches.

2. The halogen incandescent lamp in claim 1, wherein the average radius of curvature of the light-exit window is greater than the average radius of curvature of the vessel section.

3. The halogen incandescent lamp in claim 1, wherein the width, which is measured transversely with respect to the lamp vertical axis, of the emission window is greater than the depth, which is measured at right angles with respect thereto, of the vessel section.

4. The halogen incandescent lamp in claim 1, the lowest point of the constriction lying on a plane of symmetry with respect to the filament branches.

5. The halogen incandescent lamp in claim 1, wherein the luminous element being fixed in position by means of holding knobs.

6. The halogen incandescent lamp in claim 5, wherein a holding knob extends from a vertex region of the bulged-out vessel section and a holding knob, which is arranged diametrically with respect thereto, extends away from the light-exit window towards the luminous element.

7. The halogen incandescent lamp in claim 6, wherein the filament are being connected to one another via a connecting part which is gripped by the holding knobs.

8. The halogen incandescent lamp in claim 1, wherein the side reflector is provided with a reflective layer.

9. The halogen incandescent lamp in claim 8, wherein the reflective layer is applied to the outer circumference of the vessel section.

10. The halogen incandescent lamp in claim 1, wherein the sealed end of the lamp vessel is in the form of a base.

11. The halogen incandescent lamp in claim 10, wherein the lamp vessel has a bulb portion that merges with the base via a circumferential bevel.

12. The halogen incandescent lamp in claim 10, wherein the base is arranged to be closer to the vertex of the vessel section than to the vertex of the light-exit window.

13. The halogen incandescent lamp in claim 2, the width, which is measured transversely with respect to the lamp vertical axis, of the emission window is greater than the depth, which is measured at right angles with respect thereto, of the vessel section.

14. The halogen incandescent lamp in claim 11, the base being positioned closer to the vertex of the vessel section than to the vertex of the light-exit window.

* * * * *